United States Patent [19]

Archer

[11] 3,947,038

[45] Mar. 30, 1976

[54] MAP BOARD GAME

[75] Inventor: Edward Archer, Brooklyn, N.Y.

[73] Assignee: Lawrence Peska Associates, Inc., New York, N.Y. ; a part interest

[22] Filed: Apr. 14, 1975

[21] Appl. No.: 568,009

[52] U.S. Cl..... 273/134 AC; 273/134 C; 273/134 E

[51] Int. Cl.[2] ..... A63F 3/04

[58] Field of Search ..... 273/134

[56] References Cited

UNITED STATES PATENTS

| | | | |
|---|---|---|---|
| 940,855 | 11/1909 | Clemens | 233/134 AC |
| 1,653,464 | 12/1927 | Lomas | 273/134 AD |
| 3,674,273 | 7/1972 | Sells | 273/134 AA |

*Primary Examiner*—Delbert B. Lowe

*Attorney, Agent, or Firm*—Richard E. Nanfeldt

[57] ABSTRACT

A map board game consists of a playing board having a map printed thereon, wherein a grid system consisting of squares is also printed on the playing surface. Spinner devices for moving in latitudinal and longitudinal directions on the map are provided, as well as a compass spinner device. Nation cards are provided for indicating nations acquired by a player landing on a particular nation.

5 Claims, 7 Drawing Figures

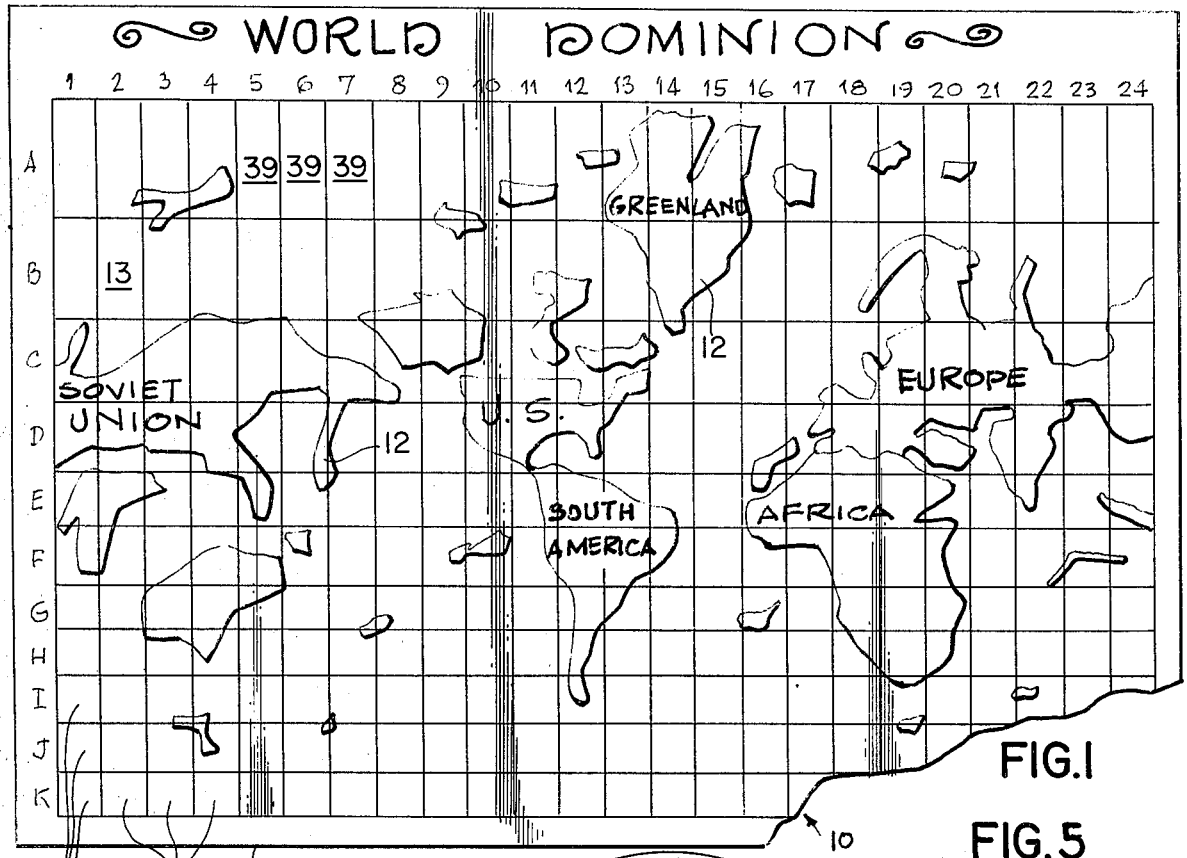
FIG.1
FIG.4
FIG.5
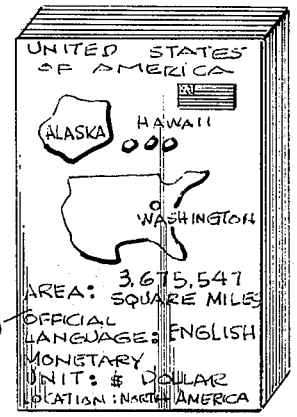
FIG.2
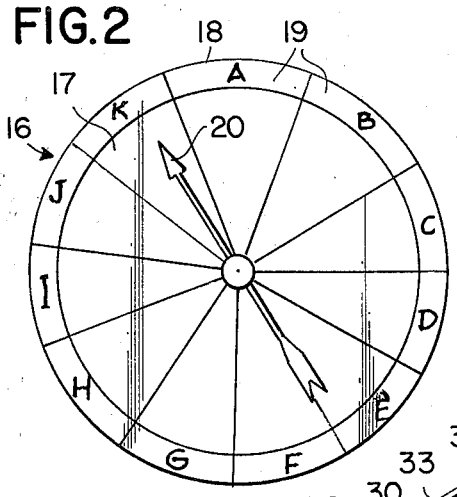
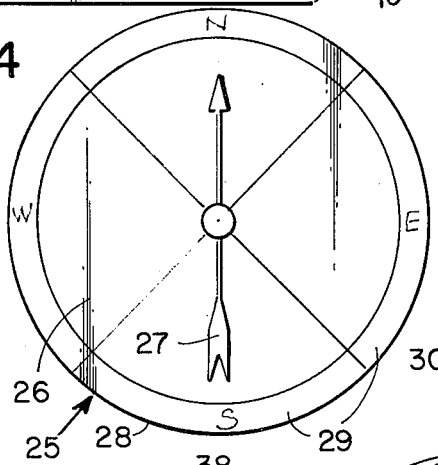
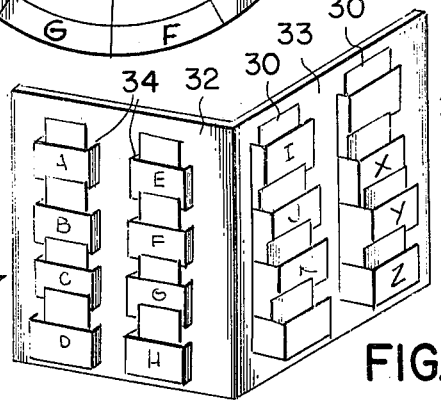
FIG.6
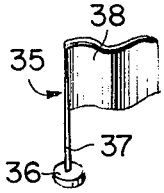
FIG.7
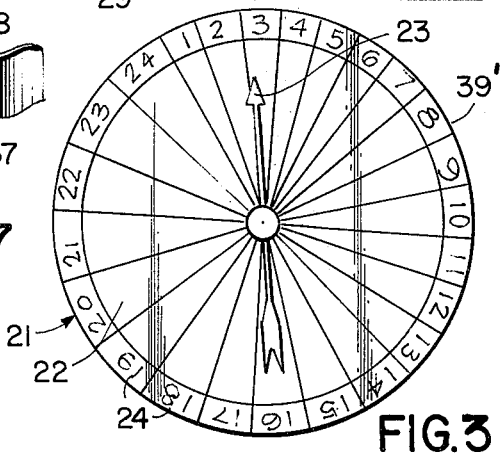
FIG.3

MAP BOARD GAME

SUMMARY OF THE INVENTION

My invention relates to a unique and novel map board game used as an educational teaching aid and a form of entertainment.

A number of U.S. Pat. Nos. 983,925; 2,347,094; and 3,711,966 have employed a geographical board game, but these aforementioned board games are non-applicable to my present invention.

An object of my present invention is to provide a map board game of a given geographical area such as the world, wherein the board game can be used as a teaching aid for geographical and political parameters.

A further object of my invention is to provide a means for moving across the map of the board simultaneously in a latitudinal and longitudinal direction.

Briefly, my present invention comprises a playing board having a map printed thereon, wherein a grid system consisting of squares is also printed on the playing surface. Spinner devices for moving in latitudinal and longitudinal directions on the map are provided, as well as a compass spinner device. Nation cards are provided for indicating nations acquired by a player landing on a particular nation.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a top view of the playing board of a map board game;

FIG. 2 illustrates a top view of a latitudinal spinner device;

FIG. 3 illustrates a top view of a longitudinal spinner device;

FIG. 4 illustrates a top view of a compass spinner device;

FIG. 5 illustrates a front perspective view of a deck of nation cards;

FIG. 6 illustrates a front perspective view of a nation card holding device; and FIG. 7 illustrates a front perspective view of a marking device used in the map board game.

DESCRIPTION OF THE PREFERRED EMBODIMENT

Turning now descriptively to the drawings, in which similar reference characters denote similar elements throughout the several views, FIG. 1 shows a map board game 10 called "World Dominion", wherein the game 10 is a geo-political educational game for children and adults. The board game 10 comprises a rectangular shaped planar playing board 11 having a map 12 of the world printed thereon. The playing board 11 has also a grid system 13 of a plurality of squares 39 printed thereon, wherein the grid system 13 is formed from eleven horizontal rows 14 labelled A thru K, and 24 vertical rows 15 labelled 1–24, wherein the horizontal rows 14 are representative of latitudinal and the vertical rows 15 are representative of longitudinal direction. A map of any geographical section of the world that can be subdivided into individual sections such as the United States and its 50 states can be used as an alternative to the map of the world.

FIG. 2 shows a latitudinal spinner device 16 consisting of a circular base 17 having a first spinner 20 pivotally mounted at the center of the base 17, wherein the rows 14 labelled A–K are contained along the outer periphery 18 of the base 17 in equal first contiguous annular spaces 19.

FIG. 3 shows a longitudinal spinner device 21 consisting of a circular base 22 having a second spinner 23 pivotally mounted at the center of the base 22, wherein the rows 15 labelled 1–24 are contained along the outside periphery 39 of the base 22 in equal second contiguous annular spaces 24.

FIG. 4 shows a compass spinner device 25 consisting of a circular base 26 having a third spinner 27 pivotally mounted at the center of the base 26, wherein the outside periphery 28 of base 26 is subdivided into third contiguous spaces 29 representative of North, South, East and West.

FIG. 5 shows a plurality of national playing cards 30 representing the various nations of the world, wherein various data of each country is printed on the card 30.

FIG. 6 shows a nation card holding device 31 consisting of two vertical boards 32, 33 perpendicularly joined together, wherein each board 32, 33 has a plurality of slots 34 therein, one slot for each letter of the alphabet. The nation cards 30 are inserted into the slots 34, corresponding to the first letter of a nation's name.

FIG. 7 shows a marker device 35 used by each player to represent his position on the playing board 11. The marker device 35 consists of a circular bottom base 36 having an upwardly extending vertical rod 37 thereon, wherein a flag 38 is affixed onto an upper portion of the rod 37.

The game is played as follows;

After the players have decided by appropriate means the order of play, the first player spins spinners 16, 21 to determine his position on the grid system 13. The player moves his marker device 35 to the appropriate position on the grid system 13. The player takes possession of the nation card 30 representing the nation or any portion thereof contained on the square 39 of the grid system where he has landed. If more than one nation or its portion is contained within the square 39, the player chooses the largest nation contained therein. The player draws out his nation card 30 from the nation card holding device 31. Landing on a piece of land belonging in reality to another nation, such as Greenland being owned by Denmark, would be similar to landing on Denmark itself. If a player lands on a square 39 contained in an ocean area, he immediately spins the compass spinner device 25 to proceed east, west, north or south to the nearest square of land. If the compass directs the player to move east or west off of the map 12, he places his marker device 35 off of the map but incurs no penalty. If the player is directed to move north or south and ends up off the map 12, the player has landed in deep freeze, wherein he loses one turn.

The players continue to move around the map 12 with the immediate goal of each player capturing a minimum of three nations in one or more geographical areas. This would qualify a player to receive another's possession, if another player lands on one of the three possessed nations, although all three nations need not be contained in a single grid. For example, if a player acquires China, India and Burma, all located in Asia, another player landing on any of these nations would have to surrender one of his nations from anywhere in the world to the owner of those three nations in Asia. Every multiple of three nations owned on any one continent by one player will allow him to receive one additional nation from an opponent who lands on any one of those nations. If six nations are owned, the player would surrender two nations. A player may surrender any nation he chooses, usually his smallest. If a player lands in a square 39 occupied by several nations with different owners, then the owner of the largest nation in that square 39 would receive the surrendered nation provided he owns at least three nations in that continent. If the square 39 still contains an unoccupied nation, the landing player can claim the unoccupied nation.

Because the U.S.S.R is both a European and Asian nation, a player taking possession of it must play it as either but not both. He must immediately declare his choice upon taking its card and adhere to it as long as the U.S.S.R. remains in his possession. If another player captures the U.S.S.R. he must similarly choose either Europe or Asia.

A confrontation takes place when the players find themselves simultaneously in the same square 39. Each player must then spin in an attempt to reach one of his own nations. The first player to reach his own nation, receives the other player's largest nation. If a confrontation occurs in deep freeze, the loser returns his nation card 30 to the holding device 31.

A player who emerges from a deep-freeze confrontation as the result of a confrontation spin-off there, may resume his normal turn in sequence even if he did not actually miss a turn as specified in deep-freeze rules. A missed turn is mandatory only while a player's marker is situated in deep-freeze under normal, nonconfrontation conditions.

The player who attains ownership of all nations acquired by everyone during the game achieves "world dominion" and is the winner of the game.

Hence, obvious changes may be made in the specific embodiment of the invention described herein, such modifications being within the spirit and scope of the invention claimed, and it is indicated that all matter contained herein is intended as illustrative and not as limiting in scope.

Having thus described the invention, what I claim as new and desire to secure by Letters Patent of the U.S. is:

1. A map board game, which comprises:

a. a playing board having a map of a world printed thereon;

b. a grid system consisting of a plurality of horizontal rows and a plurality of vertical rows intersecting each other forming a plurality of squares, wherein said horizontal rows represent latitudinal direction and said vertical rows represent longitudinal direction;

c. a latitudinal spinner device for indicating latitudinal movement on said map;

d. a longitudinal spinner device for indicating longitudinal movement on said map;

e. a compass spinner device for indicating movement on said map from an ocean area of said map;

f. a plurality of nation cards for indicating nations on said map; and g. a marker device for indicating position of each player on said map; wherein said marker device moves between said squares.

2. A map board game recited in claim 1, wherein said latitudinal spinner device has eleven contiguous spaces on an outside periphery of a circular base of said latitudinal spinner device.

3. A map board game as recited in claim 2, wherein said longitudinal spinner device has twenty four contiguous spaces on an outside periphery of a circular base of said longitudinal spinner device.

4. A map board game as recited in claim 3, wherein said compass spinner device has four contiguous spaces on an outside periphery of a circular base of said compass spinner device.

5. A map board game as recited in claim 1, wherein said map board game further includes a holding device for storing said plurality of nation cards in an alphabetical order.

* * * * *